United States Patent [19]

Campbell

[11] Patent Number: 4,637,187

[45] Date of Patent: Jan. 20, 1987

[54] PREFABRICATED BUILDING PANELS

[76] Inventor: Henry F. Campbell, 9301 Michigan Ave., Detroit, Mich. 48210

[21] Appl. No.: 761,913

[22] Filed: Aug. 2, 1985

[51] Int. Cl.[4] ..... E04B 1/74

[52] U.S. Cl. ..... 52/404; 52/241; 52/481; 52/795

[58] Field of Search ..... 52/105, 238.1, 241, 52/243, 309.7, 309.16, 694, 793, 795, 481, 650, 690, 792, 404

[56] References Cited

U.S. PATENT DOCUMENTS

| | | | |
|---|---|---|---|
| 1,211,562 | 1/1917 | Edwards, Jr. | 52/241 X |
| 2,205,725 | 6/1940 | Kavanagh | 52/795 X |
| 2,810,166 | 10/1957 | Nelsson | 52/241 X |
| 3,882,653 | 5/1975 | Ollman | 52/694 |
| 4,028,859 | 6/1977 | Bellagamba | 52/795 X |
| 4,295,312 | 10/1981 | Campbell | 52/694 X |

*Primary Examiner*—Carl D. Friedman

*Assistant Examiner*—Creighton Smith

*Attorney, Agent, or Firm*—Barnes, Kisselle, Raisch, Choate, Whittemore & Hulbert

[57] ABSTRACT

A prefabricated building panel comprising a plurality of longitudinally extending transversely spaced trusses, each truss comprising opposed channel members and undulating truss member joined to and extending between the channel members and an outer sheet and an inner sheet fastened to said channel members. The inner sheet comprises a plurality of transversely spaced grooves defined by narrow ribs extending transversely and formed by spaced portions of the inner sheet bent inwardly. The grooves have a width substantially equal to the width of the channel members of the truss and receiving one of the channel members. The base of each groove lies in the plane of the sheet such that the space between adjacent channels is maximized for receiving insulating material.

15 Claims, 6 Drawing Figures

INSIDE
OUTSIDE
10
11
12
13
14
15
16
16a
16b
17
18
18a
19
19a
20
5

PREFABRICATED BUILDING PANELS

This invention relates to building construction and particularly to prefabricated building panels.

BACKGROUND AND SUMMARY OF THE INVENTION

In order to minimize labor and costs, it has been common to provide prefabricated panels which are utilized in the construction of walls and ceilings as well as roofs. In one type of prefabricated panels, such as disclosed in U.S. Pat. Nos. 3,882,653 and 4,295,312, prefabricated trusses are provided between spaced sheets and insulating material is interposed between the sheets. However, where the sheets have grooves for receiving the trusses, as in U.S. Pat. No. 4,295,312, the major portion of the sheets between the grooves extend toward the other sheet thereby reducing the amount of insulating material that can be placed between the sheets.

Accordingly, among the objectives of the present invention are to provide a prefabricated panel which is strong, low in cost and easy to construct and, in addition, maximizes the amount of insulating material that can be used.

In accordance with the invention, the prefabricated building panel comprises a plurality of longitudinally extending transversely spaced trusses, each truss comprising opposed channel members and undulating truss member joined to and extending between the channel members and an outer sheet and an inner sheet fastened to said channel members. The inner sheet comprises a plurality of transversely spaced grooves defined by narrow ribs extending transversely and formed by spaced portions of the inner sheet bent inwardly, said grooves having a width substantially equal to the width of the channel members of the truss and receiving one of the channel members. The base of each groove lies in the plane of the sheet such that the space between adjacent channels is maximized for receiving insulating material.

DESCRIPTION

Figure 1:
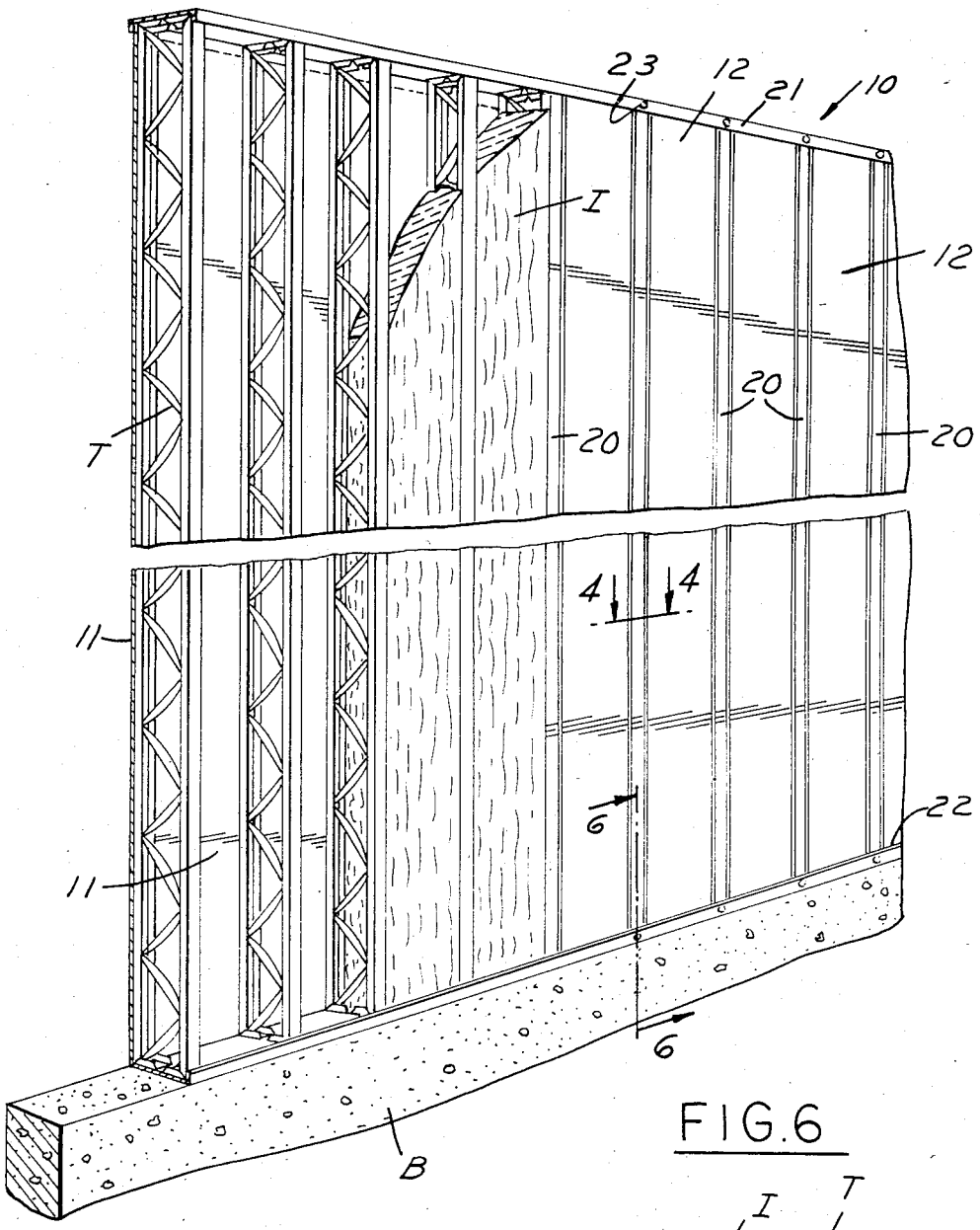
FIG. 1 is a part sectional perspective view of a portion of a building with a prefabricated panel embodying the invention.
Figures 2, 3, 4, 5:
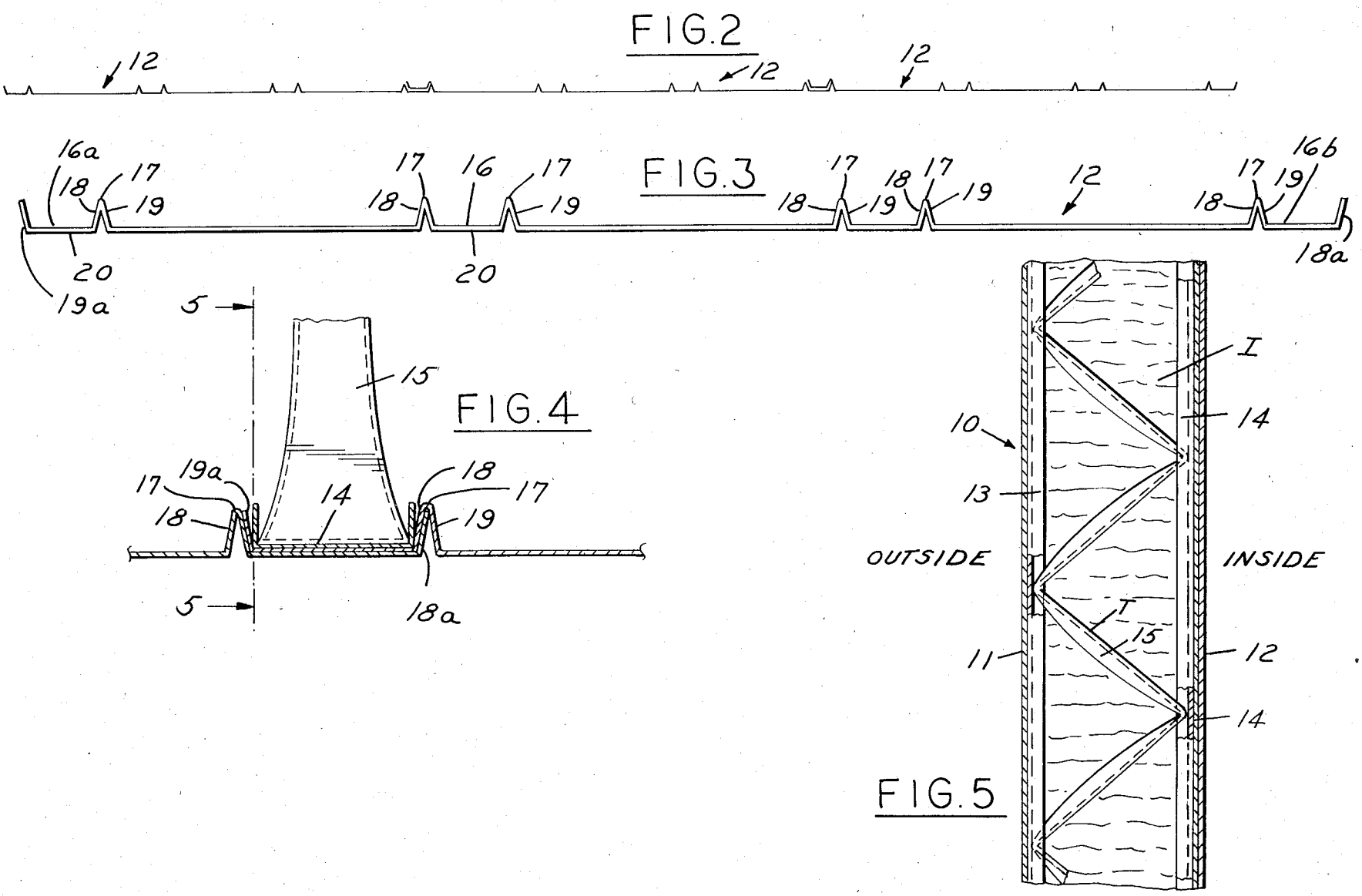
FIG. 2 is an end view of a plurality of the inner sheets of a panel showing the manner in which the inner sheets are interengaged.
FIG. 3 is an end view of an inner sheet utilized in the panel.
FIG. 4 is part sectional view of a panel embodying the invention taken along the lines 4—4 of FIG. 1 with the insulation removed.
FIG. 5 is a fragmentary sectional view taken along the line 5—5 of FIG. 4.

Referring to FIG. 1, the prefabricated building panel 10 embodying the invention comprises a plurality of prefabricated trusses T associated with one or more outer sheets 11 and one or more inner sheets 12. Each truss T comprises an outer channel 13 and an inner channel 14 with undulating member 15 fixed to the truss T (FIGS. 1, 5). The truss T is made of metal and is more fully described in U.S. Pat. No. 3,882,653, which is incorporated herein by reference.

The trusses T are provided in transversely spaced relation to one another with respect to the longitudinal axis of the sheets 11, 12 and the channels 14 are positioned in grooves 16 of the inner sheet 12 and fastened thereto by fastening means such as welding, adhesives, screws or riveting, or any combination thereof. Similarly, the outer sheet 11 is fastened to the channels 13 of the trusses T by fastening means such as welding, adhesives, screws or riveting, bending or any combination thereof.

In the assembly of the panel, the trusses are positioned in the grooves 16 of the inner sheet 12, fastened thereto as by fastening means such as welding, riveting, screws or adhesive, or any combination thereof. Thereafter the outer sheet 11 is placed in position and fastened to the channels associated with the outer sheet 11. The panel is mounted on a base B.

In accordance with the invention, the inner sheet 12 has the grooves 16 formed therein by narrow spaced ribs 17 which are bent inwardly, each rib 17 being defined by spaced walls 18, 19 with the distance between ribs 17 being such as to receive the inner channel 14 of the truss positioned in the groove 16. The base 20 of each groove 16 lies substantially in the plane of the remainder of the sheet 12 so that the space between the sheets between the sheets 11, 12 is maximized permitting the maximum amount of insulating material I to be interposed between the sheets 11, 12.

The grooves 16 thus serve as means for assembly and positioning of the trusses T as well as serve to strengthen the panel by providing greater rigidity.

Although in the preferred form, the trusses comprise space channels and an undulating member, the invention is also applicable to other types of trusses which include spaced base portions and intervening web portions or trusses comprising a one-piece member such as a beam having an I-section or C-section.

The term truss having channel members as used herein and in the claims is intended to cover such trusses which have a base and a intervening portion.

Referring to FIGS. 3 and 4, it is noted that the grooves **16*a*, 16*b* on opposite ends of each sheet 12 are mirror images of one another. Each has a single base wall 19*a*, 18*a* respectively, cooperating with the adjacent rib 17 to define the groove 16*a*, 16*b***.

The adjacent sheets of each panel are interengaged by having the side wall **18*a* of one sheet 12 engage the groove 16*a* of the adjacent sheet 12 which is provided with a truss T. Side wall 18*a* lying along the exterior of side wall 18 and side wall 19*a* of the adjacent rib 16 on the adjacent sheet lies along the interior surface of side wall 19** of the one sheet.

In the preferred form, the panel comprises three exterior and interior sheets interengaged as shown in FIG. 2.

To complete the panel, top and bottom channel members 21, 22 are telescoped over the ends of the trusses and sheets and fastened thereto as by screws 23. The prefabricated panel can be handled as a unit and placed in position as, for example, on a base or sill wall B.

Figure 6:
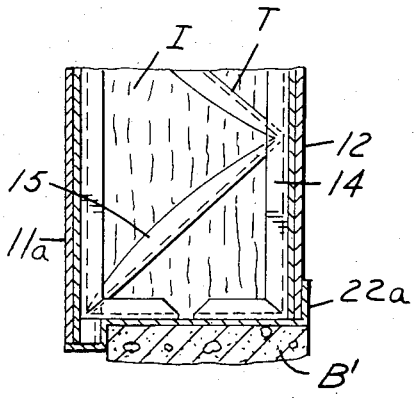
FIG. 6 is a fragmentary perspective view of a portion of a building with a modified form of prefabricated panel.

When the panel is used on the outside of a building as shown in FIG. 6, the outer shell **11*a* is made similarly to the inner shell 12 and is coated. In addition, the bottom member 22*a* is of stepped construction so that the outer sheet 11a engages member 22*a*** long the base B'.

I claim:

1. A prefabricated building panel comprising a plurality of longitudinally extending transversely spaced trusses, each truss comprising opposed bases and an intervening portion extending between the bases, a first sheet and a second sheet fastened to one of said bases, insulating material between said sheets, said first sheet comprising a plurality of transversely spaced grooves defined by transversely spaced narrow ribs extending longitudinally and formed by closely spaced portions of the first sheet bent inwardly, said grooves having a base wall and a side wall width substantially equal to the width of one of the bases of the truss and receiving one of the bases, the base of each groove lying in the plane of the sheet and the width of said ribs being substantially less than the width of said grooves such that the overall appearance of the exterior of said first sheet appears to be planar and substantially uninterrupted except for narrow lines defined by the space between the closely spaced portions of the ribs and such that the space between adjacent bases is maximized for receiving insulating material.

2. The prefabricated panel set forth in claim 1 wherein each end of said first sheet comprises a groove defined by a rib, a single base wall, and a single side wall extending inwardly, the grooves at one end of said first sheet being the mirror image of the other end of said first sheet, such that a third adjacent sheet of another prefabricated panel at one end of said first mentioned sheet has the single side wall of said third sheet extending between the side walls of the ribs at the end of said first mentioned sheet and engaging a side wall of said groove, the base wall of the groove at the end of the adjacent third sheet engaging the base wall of the groove at the end of the first mentioned sheet and the single side wall at the free end of the first mentioned sheet engaging the side wall of the groove at the end of the third adjacent sheet.

3. The prefabricated panel set forth in claim 2 wherein said prefabricated panel comprises a plurality of inner sheets with the ends interengaged, the single wall of one sheet extending into the rib of the groove on the adjacent sheet and the single wall of the adjacent sheet engaging the rib of the one sheet.

4. The prefabricated panel set forth in claim 3 including transverse cap members fastened at each end of said panel.

5. The prefabricated panel set forth in claim 1 wherein said second sheet comprises a plurality of spaced grooves defined by transversely spaced narrow ribs extending longitudinally and formed by closely spaced portions of the second sheet bent downwardly, said grooves receiving the other of said base members.

6. The prefabricated panel set forth in any one of claims 1–5 including a base on which said panel is mounted.

7. A prefabricated building panel comprising a plurality of longitudinally extending transversely spaced trusses, each truss comprising opposed channel members and an undulating truss member joined to and extending between the channel members, a first sheet and second sheet fastened to said channel members, insulating material between said sheets, said first sheet comprising a plurality of transversely spaced grooves defined by transversely spaced ribs extending transversely and formed by closely spaced portions of said first sheet bent inwardly, said grooves having a base wall and side walls defined by said groove width substantially equal to the width of the channel members of the truss and receiving one of the channel members, the base of each groove lying in the plane of the sheet and a single side wall extending inwardly, the grooves at one end of said inner sheet being the mirror image of the other end of said inner sheet, such that the space between adjacent channels is maximized for receiving insulating material.

8. The prefabricated panel set forth in claim 7 wherein each end of said first sheet comprises a groove defined by a rib, a single wall and a single side wal extending inwardly, the grooves at one end of said first sheet being the mirror image of the other end of said first sheet, such that a third adjacent sheet of another prefabricated panel at one end of said first mentioned sheet has the single side wall of said third sheet extending between the side walls of the rib at the end of said first mentioned sheet and engaging a side wall of said groove, the base wall of the groove at the end of the adjacent third sheet engaging the base wall of the groove at the end of the first mentioned sheet and the single side wall at the free end of the first mentioned sheet engaging the side wall of the groove at the end of the third adjacent sheet.

9. The prefabricated panel set forth in claim 8 wherein said prefabricated panel comprises a plurality of inner sheets with the ends interengaged, the single wall of one sheet extending into the rib of the groove on the adjacent sheet and the single wall of the adjacent sheet engaging the rib of the one sheet.

10. The prefabricated panel set forth in claim 9 including transverse cap members fastened at each end of said panel.

11. The prefabricated panel set forth in claim 7 wherein said outer shell comprises a plurality of spaced grooves defined by ribs extending transversely and formed by spaced portions of the outer shell bent downwardly, said grooves receiving the other of said base members.

12. The prefabricated panel set forth in any one of claims 7–11 including a base on which said panel is mounted.

13. A prefabricated building panel comprising a plurality of longitudinally extending transversely spaced trusses, each truss comprising opposed bases and an intervening portion extending between the bases, a sheet fastened to one of said bases of said trusses, said sheet comprising a plurality of transversely spaced grooves defined by transversely spaced narrow ribs extending longitudinally and formed by closely spaced portions of the sheet bent inwardly, said grooves having a base wall and a side wall width substantially equal to the width of one of the bases of the truss and receiving one of the bases, the base of each groove lying in the plane of the sheet and the width of said ribs being substantially less than the width of said grooves such that the overall appearance of the exterior of said first sheet appears to be planar and substantially uninterrupted except for narrow lines defined by the space between the closely spaced portions of the ribs, transverse cap members fastened at each end of said panel connected to said sheet and said trusses.

14. The prefabricated panel set forth in claim 13 wherein each end of said inner sheet comprises a groove defined by a rib, a single wall and a single side wall extending inwardly, the grooves at one end of said inner sheet being the mirror image of the other end of said inner sheet, such that a second adjacent sheet of another prefabricated panel at one end of said first mentioned sheet has the single side wall of said second sheet extending between the side walls of the rib at the end of said first mentioned sheet and engaging a side wall of said groove, the base wall of the groove at the end of the adjacent second sheet engaging the base wall of the groove at the end of the first mentioned sheet and the single side wall at the free end of the first mentioned sheet engaging the side wall of the groove at the end of the second adjacent sheet.

15. The prefabricated panel set forth in claim 14 wherein said prefabricated panel comprises a plurality of sheets with the ends interengaged, the single wall of one sheet extending into the rib of the groove on the adjacent sheet and the single wall of the adjacent sheet engaging the rib of the one sheet.

* * * * *